US005310632A

United States Patent [19]

Oppenheimer

[11] Patent Number: 5,310,632

[45] Date of Patent: May 10, 1994

[54] PHOTOGRAPHIC ADDITIVE DISPERSIONS AND A METHOD OF PREPARING THE SAME

[75] Inventor: Larry E. Oppenheimer, Rochester, N.Y.

[73] Assignee: Eastman Kodak Company, Rochester, N.Y.

[21] Appl. No.: 939,508

[22] Filed: Sep. 1, 1992

Related U.S. Application Data

[63] Continuation-in-part of Ser. No. 833,868, Feb. 10, 1992, abandoned.

[51] Int. Cl.[5] ..... G03C 1/04; G03C 1/38

[52] U.S. Cl. ..... 430/449; 430/546; 430/631

[58] Field of Search ..... 430/546, 449, 631

[56] References Cited

U.S. PATENT DOCUMENTS 3,860,425 1/1975 Ono et al. ..... 430/546
4,004,927 1/1977 Yamamoto et al. ..... 430/631

FOREIGN PATENT DOCUMENTS 277343 3/1990 German Democratic Rep. .
63-5339 1/1988 Japan .

*Primary Examiner*—Charles L. Bowers, Jr.
*Assistant Examiner*—Mark F. Huff
*Attorney, Agent, or Firm*—David F. Janci

[57] ABSTRACT

A dispersion of a photographic additive in a hydrophilic colloid having improved stability against the formation of crystals by incorporated into the oil phase of the dispersion prior to mixing, less than 2 percent by weight, based on the weight of the oil phase, of a compound having the formula

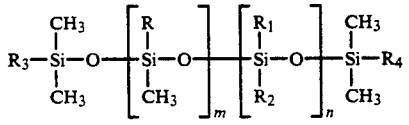

wherein R, $R_1$, $R_2$, $R_3$, and $R_4$ are independently selected from alkyl including linear, branched or in substituted alkyl having from 1 to 25 carbon atoms, the substituents being aryl, halo, cyano; aryl, including substituted aryl, the substituents being alkyl or halo; wherein addition to the above, R may also be a siloxane or polysiloxane to give a branched molecule; and in addition to the above, $R_3$ and $R_4$ may also be alkoxy and m and n have values from 0 to 5000.

10 Claims, No Drawings

PHOTOGRAPHIC ADDITIVE DISPERSIONS AND A METHOD OF PREPARING THE SAME

This application is a continuation in part of application Ser. No. 07/833,868 filed Feb. 10, 1992, now abandoned, the entire disclosure of which is incorporated herein by reference.

BACKGROUND OF THE INVENTION

1. Field of the Invention

This invention relates to photographic additive aqueous dispersions having a neglectable amount of crystallization therein and to a method of preparing such dispersions.

2. Description of related Art

Photographic additives are usually incorporated into photographic systems as a colloidal emulsion, usually called a dispersion in the photographic art. The additives are very often water insoluble or substantially water insoluble and this characteristic makes the preparation of the dispersion difficult especially where small particles are desired. To prepare these dispersions, the photographic additives are added to a high boiling water immiscible solvent, generally called a permanent solvent. At times, a low boiling solvent or a water miscible solvent (generally called an auxiliary solvent) is added to promote the solubility of the photographic additives. The thus formed mixture is heated to form a solution. This solution is mixed under high shear, together with an aqueous gelatin solution, generally containing a surfactant at elevated temperatures in order to break the organic phase (oil phase) into sub-micron droplets dispersed in the continuous aqueous phase. When an auxiliary solvent is employed, it is removed from the dispersion prior to the employment of the dispersion in the preparation of a photographic element. Regardless of whether or not an auxiliary solvent is employed, a common problem regarding dispersions of water insoluble photographic chemicals is that they are frequently unstable. One result is the formation of crystals of the chemicals in the dispersion. These crystals can interfere with the functioning of the dispersion, its coatability and it optical properties. It is therefore desirable to suppress crystal formation in photographic dispersions.

U.S. Pat. No. 3,860,425 describes the use of non-ionic surfactants containing polyoxyethylene and polyoxypropylene units as dispersion aids for the suppression of crystal formation.

East German Patent DD 277,343A discloses the use of polysiloxane/polyether copolymer surfactants utilized in the preparation of photographic dispersions to decrease the amount of coarse dispersed particles of high boiling organic solvent. The invention disclosed in this East German patent eliminates dispersed particles greater than 0.2 μm, thereby improving the transparency of layers produced from the photographic dispersions.

SUMMARY OF THE INVENTION

The invention provides a dispersion of a photographic additive in a hydrophillic colloid having improved stability against the formation of crystals by incorporation into the oil phase of the dispersion prior to mixing, less than 2 percent by weight, based on the weight of the oil phase, of a compound having the formula:

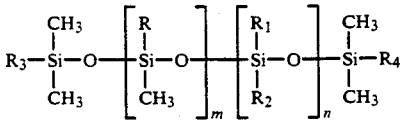

wherein R, $R_1$, $R_2$, $R_3$, and $R_4$ are independently selected from alkyl including linear, branched or substituted alkyl having from 1 to 25 carbon atoms, the substituents being aryl, halo, cyano; aryl, including substituted aryl, the substituents being alkyl or halo; where in addition to the above, R may also be a siloxane or polysiloxane to give a branched molecule; and in addition to the above $R_3$ and $R_4$ may also be alkoxy and m and n have values from 0 to 5000. The invention also is directed to a method of preparing dispersions of photographic additives by adding to the oil phase in the preparation of the dispersion, less than 2 percent by weight based on the weight of the oil phase of the compound identified above.

DESCRIPTION OF PREFERRED EMBODIMENTS

Thus, the invention contemplates the preparation of a dispersion of a photographic additive in a hydrophillic colloid wherein the photographic additive is incorporated into the oil phase or the dispersed phase in a hydrophillic colloid which forms the continuous phase. During the preparation of the dispersion, a siloxane in accordance with the formula represented above is incorporated into the oil phase in an amount less than 2 percent by weight based on the weight of the oil phase. Since the siloxane compounds represented are soluble in the oil phase but not in the water phase, they remain in the dispersed droplet particles. It has been found that by incorporating this small amount of a siloxane compound in the oil phase that crystallization of the photographic additive is greatly reduced.

By "photographic additives" is meant those additives which cannot be dissolved in water in amounts exceeding 3 percent by weight at room temperature (about 20° C.). Photographic additives in accordance with the present invention include, for example, couplers, DIR noncolor-forming coupling compounds, dyes including spectrally sensitizing dyes and lightscreening dyes for example, antihalation and filter dyes, stabilizing agents including UV light absorbing agents, emulsion stabilizing agents and antioxidation agents and the like.

The photographic additive dispersions in accordance with this invention are prepared by forming an oil phase of the photographic additive together with a permanent solvent and a suitable siloxane compound within the formula expressed above. As previously indicated, an auxiliary solvent may be employed in order to aid the photographic additive to dissolve in the solvents. The oil phase is then mixed together with an aqueous phase containing water, a hydrophillic colloid, and an anionic surfactant under high shearing action in order to divide the oil phase into the desired particle size. After this step, if an auxiliary solvent has been employed in the preparation of the oil phase, the auxiliary solvent is removed either by evaporation or by washing depending upon the type of solvent employed.

Any suitable polysiloxane in accordance with the expressed formula may be employed where R, $R_1$, $R_2$, $R_3$, and $R_4$ are selected from alkyl, including linear, branched or substituted alkyl having from 1 to 25 carbon atoms such as, for example methyl, ethyl, n-propyl, isopropyl, n-butyl, isobutyl, tertiary butyl, amyl, octyl stearyl, dodecyl, phenyl ethyl, naphthyl, butyl, chloromethyl, fluoropropyl cyanoethyl and the like; aryl including substituted aryl, such as, for example, phenyl, naphthyl, tolyl, xylyl, ethylphenyl, chlorophenyl, fluorophenyl, dichlorophenyl, pentachlorophenyl and the like; R may also be

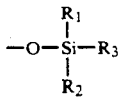

or

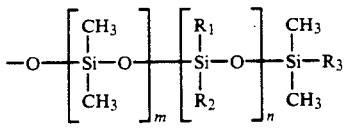

where $R_1$, $R_2$, $R_3$, m and n have the same meaning as set forth above; and $R_3$ and $R_4$ may in addition be alkoxy including methoxy, ethoxy, stearoxy, behenoxy and the like. The preferred additive compounds are polydimethyl siloxanes.

Suitable compounds include:

Compound I.

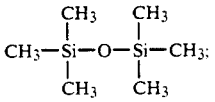

Compound II.

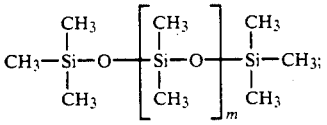

m = 8

Compound III.

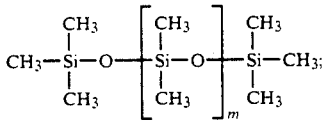

m = 5000

Compound IV.

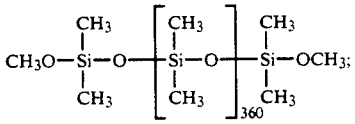

Compound V.

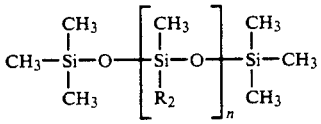

where: $R_2$ = n-hexyl
n = 34;

Compound VI.

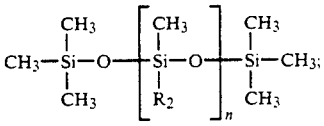

-continued where: $R_2$ = n-octyl
n = 35;

Compound VII.

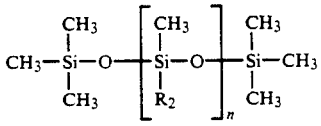

where: $R_2$ = n-stearyl
n = 35.

As indicated previously the invention is applicable to a broad range of photographic additives. Oil soluble couplers including yellow couplers, in general, open chain diketo-methylene compounds are widely used. Examples are disclosed in U.S. Pat. Nos. 3,341,331,; 2,875,075 and 3,551,155, German Patent Application (OLS) 1,547,868, U.S. Pat. Nos. 3,265,506; 3,582,322 and 3,725,072, German Patent Application (OLS) 2,162,899, U.S. Pat. Nos. 3,369,895 and 3,408,194, German Patent Applications (OLS) 2,057,941; 2,213,461; 2,219,917; 2,261,361 and 2,263,875, and the like.

Magenta couplers including 5-pyrazolone compounds, indazolone compounds and cyanoacetyl compounds can be used. Examples are described in U.S. Pat. Nos. 2,439,098; 2,600,788; 3,062,653 and 3,558,319, British Patent 956,261, U.S. Pat. Nos. 3,582,322; 3,615,506; 3,519,429; 3,311,476 and 3,419,391, Japanese Patent Applications (OPI) 111631/74 and 13041/75, German Patent 1,810,464, Japanese Patent Publication 16/69, Japanese Patent Application (OPI) 131448/74, U.S. Pat. No. 2,983,608, and the like.

Cyan couplers, such as, phenol or naphthol derivatives are generally used. Examples are disclosed in U.S. Pat. Nos. 2,369,929; 2,474,293; 2,698,794; 2,895,826; 3,311,476; 3,458,315; 3,560,212; 3,582,322; 3,591,383; 2,434,272; 2,706,684; 3,034,892 and 3,583,971, German Patent Application (OLS) 2,163,811, Japanese Patent Publication 28836/70, Japanese Patent Application (OPI) 122335/74, and the like.

Colored couplers are disclosed, for example, in U.S. Pat. Nos. 3,476,560; 2,521,908 and 3,034,492, Japanese Patent Publications 2016/69, 22335/63, 11304/67 and 32461/69, British Patent 1,489,080, German Patent Applications (OLS) 2,643,965 and 2,418,959, and the like.

The present invention is also applicable to couplers which release a development inhibiting compound upon color development (DIR couplers). Examples are disclosed in, U.S. Pat. Nos. 3,227,554; 3,617,291; 3,701,783; 3,790,384 and 3,632,345, German Patent Applications (OLS) 2,414,006; 2,454,301 and 2,454,329, British Patents 953,454, and 1,513,537, U.S. Pat. Nos. 3,297,445 and 3,379,529, and German Patent Application (OLS) 2,417,914.

Mixtures of two or more of the couplers or compounds described above can be dispersed at the same time.

Photographic additives include stabilizing agents such as, oil-soluble UV absorbing agents in accordance with those set forth in Japanese Patent Publication 21687/67 and U.S. Pat. Nos. 3,533,794; 3,794,493 and 3,707,375.

Oil-soluble antioxidant stabilizers set forth in U.S. Pat. Nos. 2,336,327; 2,728,659; 2,835,579 and 3,700,433, and the like can also be employed.

Fade preventing agents for the finished dye image to which the present invention is applicable include those set forth in Belgian Patent 777,487, German Patent 1,547,684 and German Patent Application (OLS) 2,146,668, and the like.

Oil soluble dye precursors to which the present invention is applicable and which can be employed in diffusion transfer color photographic elements include, for example, dye releasing redox compounds set forth in Japanese Patent Application (OPI) 11424/74 and U.S. Pat. Nos. 4,076,529; 3,932,381; 3,954,476; 3,942,987; 4,013,635 and 4,055,428.

Any suitable permanent solvent may be used in the practice of this invention, for example, esters, such as, phthalates, phosphates, citrates, benzoates, fatty acid esters, carbonates, and the like; amides, such as, fatty acid amides, sulfonamides, and the like; ethers, such as, allyl ethers, and the like, alcohols, paraffins, and the like. Most preferably used are high boiling organic solvents, for example, phthalate esters, such as, dibutyl phthalate, dihexyl phthalate, diheptyl phthalate, dioctyl phthalate, dinonyl phthalate, didecyl phthalate, butylphthalylbutyl glycolate, dibutyl monochlorophthalate, and the like; phosphoric acid esters, such as, tricresyl phosphate, trixylyl phosphate, tris(isopropylphenyl) phosphate, tributyl phosphate, trihexyl phosphate, trioctyl phosphate, trinonyl phosphate, tridecyl phosphate, trioleyl phosphate, tris(butoxyethyl) phosphate, tris(chloroethyl) phosphate, tris(dichloropropyl) phosphate, and the like; citric acid esters, such as, o-acetyltriethyl (or butyl, hexyl, octyl, nonyl, decyl) citrate, triethyl (or butyl, hexyl, octyl, nonyl, decyl, tridecyl) citrate, and the like; benzoic acid esters, such as butyl (or hexyl, heptyl, octyl, nonyl, decyl, dodecyl, tridecyl, tetradecyl, hexadecyl, octadecyl, oleyl) benzoate, and the like, pentyl o-methylbenzoate, decyl p-methylbenzoate, octyl o-chlorobenzoate, lauryl p-chlorobenzoate, propyl 2,4-dichlorobenzoate, octyl 2,4-dichlorobenzoate, stearyl 2,4-dichlorobenzoate, oleyl 2,4-dichlorobenzoate, octyl p-methoxybenzoate, and the like; fatty acid esters, such as, hexadecyl maleate, dibutoxyethyl succinate, dioctyl adipate, dioctyl azelate, decamethylene-1, 10-diol diacetate, triacetin, tributin, benzyl caproate, pentaerythritol tetracaproate, isosorbide dicaprylate, and the like; amides, such as, N,N-dimethyllauramide, N,N-diethylcaprylamide, N-butylbenzenesulfonamide, and the like; trioctyl trimellitate, chlorinated paraffin, and the like; including those solvents disclosed in U.S. Pat. Nos. 2,322,027; 2,533,514 and 2,835,579, Japanese Patent Publication 23233/71, U.S. Pat. No. 3,287,134, British Patent 958,441, Japanese Patent Application (OPI) 1031/72, British Patent 1,222,753, U.S. Pat. No. 3,936,303, Japanese Patent Applications (OPI) 26037/76 and 82078/75, U.S. Pat. Nos. 2,353,262; 2,852,383; 3,554,755; 3,676,137; 3,676,142; 3,700,454; 3,748,141; 3,837,863, German Patent Application (OLS) 2,538,889, Japanese Patent Applications (OPI) 27921/76, 27922/76, 26035/76, 26036/76 and 62632/75, Japanese Patent Publication 29461/74 and U.S. Pat. No. 3,936,303.

Occasionally in the practice of the present invention, it is advantageous to employ, together with a high boiling solvent cited above, a low boiling auxiliary solvent (having a boiling point not to exceed 130° C.) or a high boiling water-miscible solvent to dissolve the oil-soluble photographic additive. Such water miscible high boiling point solvents or volatile solvents include, for example, propylene carbonate, ethyl acetate, butyl acetate, ethyl propionate, secbutyl alcohol, tetrahydrofuran, cyclohexanone, dimethylformamide, diethyl sulfoxide, methyl cellosolve, carbitol, and the like.

The emulsifying apparatus used to practice the present invention should preferably be such as to be able to impart high shear on the liquid to be treated, or to transmit ultrasonic energy of high intensity. Suitable apparatus include colloid mills, homogenizers, microporous emulsifiers, liquid sirens, electromagnetic strain type ultrasonic generators, and emulsifiers provided with Pollmann's whistle.

The hydrophilic colloid is a binder or protective colloid for the silver halide photographic light-sensitive materials.

Gelatin is most preferably used as binder or protective colloid in the present invention, though other hydrophilic colloids may also be used. Other suitable hydrophilic materials include, for example, gelatin derivatives, graft copolymers comprising gelatin and other polymeric materials, albumin, casein and other forms of protein, cellulose derivatives such as hydroxyethyl cellulose, carboxymethyl cellulose, the sulfuric acid ester of cellulose, and the like, carbohydrate derivatives such as sodium alginate, starch and its derivatives, and the like, various synthetic polymer materials such as poly(vinyl alcohol), partially acetalized poly(vinyl alcohol), poly-N-vinylpyrrolidone, poly(acrylic acid), poly(methacrylic acid), polyacrylamide, polyvinylimidazole,-polyvinylpyrazole, and the like, and copolymers consisting of the monomer unit contained in the above cited polymers.

Among various types of gelatin, one can use alkaline processed gelatin, acid processed gelatin, the hydrolyzed product therefrom, or the peptized product therefrom with an enzyme. Suitable gelatin derivatives include the reaction products obtained by subjecting gelatin to reactions with a number of reagents such as acid halide, acid anhydride, isocyanate, bromoacetic acid, alkane sultone, vinylsulfonamide, maleinimide, polyalkylene oxide, epoxide, and the like. Reference can be made to U.S. Pat. Nos. 2,614,928; 3,132,945; 3,186,846 and 3,312,553, British Patents 861,414; 1,033,189 and 1,005,784 and Japanese Patent Publication 25845/67.

Representative hydrophilic synthetic polymeric materials include those described in, for example, German Patent Application (OLS) 2,312,708, U.S. Pat. Nos. 3,620,751 and 3,879,205, Japanese Patent Publication 7561/68.

The invention will be further illustrated by the following examples.

EXAMPLE 1 cl Control

An oil phase was prepared by heating to 66° C. 15 g of Cl, 30 g of ethyl acetate and 15 g of dibutyl phthalate. An aqueous phase was prepared by heating to 50° C. 101.8 g of water, 25.44 g gelatin, 12.72 g of a 10% solution of Sl, and 2.2 cc of 2 normal propionic acid.

The oil phase was stirred into the aqueous phase and the mixture was passed through a colloid mill five times. The resulting dispersion was treated in a vacuum evaporator to remove the ethyl acetate and water was added to make up the lost weight. The average particle size of the resulting dispersion was 0.206 microns (turbidity average diameter). The dispersion had a relative reactivity of 6835 and the viscosity was 84 cP at a shear rate of 6 $sec^{-1}$. Microscopic examination at 100X with crossed polarizers showed the presence of one or two very small crystals in each field. A sample of this dispersion was incubated at 45° C. for 24 hours. Microscopic examination showed that the incubated sample was heavily crystallized.

EXAMPLE 2

A dispersion was made as in Example 1, except 0.5 g of S2 was added to the oil phase. The average particle size of the resulting dispersion was 0.207 microns. The dispersion had a relative reactivity of 7399 and the viscosity was 100 cP at 6 $sec^{-1}$. Microscopic examination of the fresh dispersion as in Example 1 showed the presence of one or two very small crystals in each field. A sample of this dispersion was incubated at 45° C. for 24 hours. Microscopic examination showed that the incubated sample contained only a few more crystals than did the fresh dispersion.

EXAMPLE 3

A dispersion was made as in Example 1, except 0.5 g of S3 was added to the oil phase. The average particle size of the resulting dispersion was 0.202 microns. The dispersion had a relative reactivity of 7262 and the viscosity was 94 cP at 6 $sec^{-1}$. Microscopic examination of the fresh dispersion as in Example 1 showed the presence of one or two very small crystals in each field. A sample of this dispersion was incubated at 45° C. for 24 hours. Microscopic examination showed that the incubated sample contained more crystals than did the fresh dispersion but only about 1/10 the amount of crystallized material as did the incubated dispersion from Example 1.

EXAMPLE 4

Control

An oil phase was prepared by heating to 66° C. 23 g of C2, 11.5 g of tricresyl phosphate and 34.5 g of ethyl acetate. An aqueous phase was prepared by heating to 50° C. 127.2 g water, 24 g gelatin, 8.8 g of a 10% solution of Sl, and 3.3 cc of 2 normal propionic acid. The oil phase was stirred into the aqueous phase and the mixture was passed through a colloid mill five times. The resulting dispersion was treated in a vacuum evaporator to remove the ethyl acetate and water was added to make up the lost weight. The average particle size of the resulting dispersion was 0.220 microns (turbidity average diameter). The dispersion had a relative reactivity of 10680 and the viscosity was 20 cP at 24 $sec^{-1}$. Microscopic examination at 100X with crossed polarizers indicated that there were no crystals in this sample. A sample of this dispersion was incubated at 45° C. for 24 hours. Microscopic examination showed that the incubated sample was heavily crystallized.

EXAMPLE 5

A dispersion was made as in Example 4, except 0.5 g of S4 was added to the oil phase. The average particle size of the resulting dispersion was 0.223 microns. The dispersion had a relative reactivity of 10904 and the viscosity was 27 cP at 24 $sec^{-1}$. Microscopic examination at 100X with crossed polarizers indicated that there were no crystals in this dispersion. A sample of this dispersion was incubated at 45° C. for 24 hours. Microscopic examination showed that the incubated sample contained more crystals than did the fresh dispersion but only about ⅓ the amount of crystallized material as did the incubated dispersion from Example 4.

An additional advantage, as shown in the above example, is that an increase in reactivity of coupler additives with oxidized developer was observed.

The compounds used throughout the examples together with their identification code are as follows:

C1

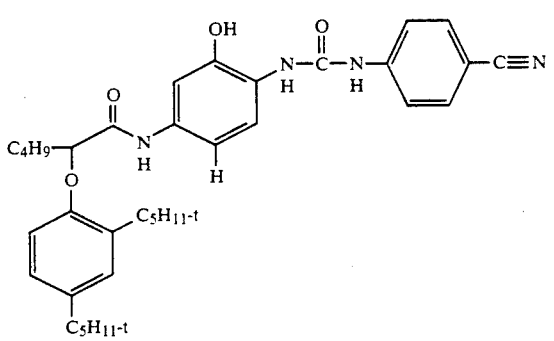

C2

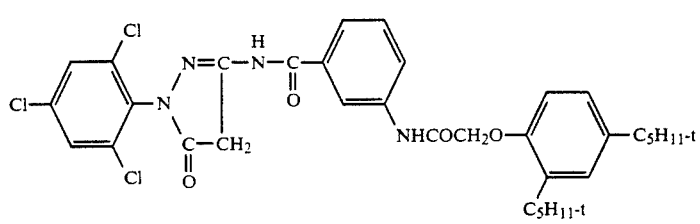

S1

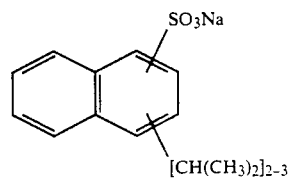

-continued

S2

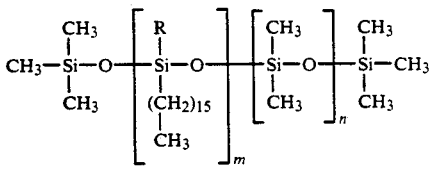

S2 is commercially available as Abil wax 9801 from Th. Goldschmidt, AG of Essen, Germany.

S3

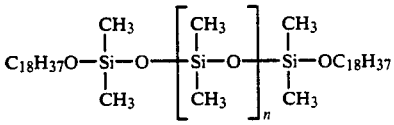

S3 is commercially available as Abil Wax 2434 from Th. Goldschmidt, AG of Essen, Germany.

S4

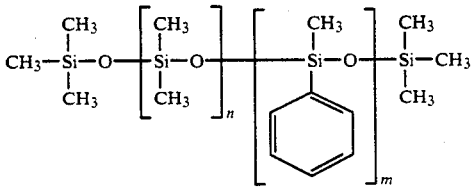

S4 is commercially available as PS063 from Petrach Systems, Inc. of Bristol, Pennsylvania.

What is claimed is:

1. In a method of dispersing an oil soluble photographic additive in water or a hydrophilic colloid composition which comprises forming an oil phase by dissolving the photographic additive in at least one organic solvent and dispersing the resulting organic solvent solution in water or in a hydrophilic colloid composition, the improvement which comprises adding to the oil phase prior to the dispersing step, a stabilizing amount to prevent crystallization of a compound having the formula

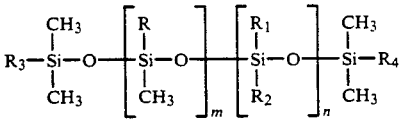

where R, $R_1$, $R_2$, $R_3$, and $R_4$ are independently selected from alkyl having from 1 to 25 carbon atoms, or aryl where in addition to the above, R can also be selected from siloxane or polysiloxane and $R_3$ and $R_4$ can also be selected from alkoxy and m and n are independently 0 to 5000.

2. The method of claim 1 wherein the compound is present in an amount less than 2 percent by weight based on the weight of the oil phase.

3. The method of claim 1 wherein the compound is present in an amount less than 1 percent by weight based on the weight of the oil phase.

4. The method of claim 1 wherein the compound is a polydimethylsiloxane.

5. The method of claim 1 wherein the photographic additive is a coupler.

6. A photographic additive dispersion of an oil soluble additive in water or a hydrophilic colloid composition comprising discontinuous oil phase of a photographic additive in at least one organic solvent dispersed in a continuous phase of water or in a hydrophilic colloid composition, the oil phase containing a stabilizing amount to prevent crystallization of a compound having the formula

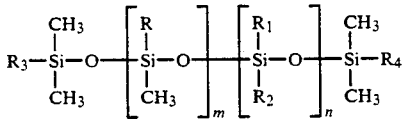

where R, $R_1$, $R_2$, $R_3$, and $R_4$ are independently selected from alkyl having from 1 to 25 carbon atoms, or aryl where in addition to the above, R can also be selected from siloxane or polysiloxane and $R_3$ and $R_4$ can also be selected from alkoxy and m and n are independently 0 to 5000.

7. The photographic additive dispersion of claim 6 wherein the compound is present in an amount less than 2 percent by weight based on the weight of the oil phase.

8. The photographic additive dispersion of claim 6 wherein the compound is present in an amount less than 1 percent by weight based on the weight of the oil phase.

9. The photographic additive dispersion of claim 6 wherein the compound is a polydimethylsiloxane.

10. The photographic additive dispersion of claim 6 wherein the additive is a coupler.

* * * * *